United States Patent [19]

Cerf

[11] Patent Number: 4,870,802

[45] Date of Patent: Oct. 3, 1989

[54] MACHINES AND METHODS FOR DOUBLING THE CAPACITY OF PACKAGING MACHINES

[75] Inventor: Alain A. Cerf, Largo, Fla.

[73] Assignee: Polycerf, Inc., Largo, Fla.

[21] Appl. No.: 269,228

[22] Filed: Nov. 9, 1988

[51] Int. Cl.[4] ..... B65B 53/02; B65B 9/06; B65B 57/10

[52] U.S. Cl. ..... 53/442; 53/76; 53/373; 53/450; 53/550; 53/557

[58] Field of Search ..... 53/76, 229, 373, 442, 53/450, 451, 550, 551, 553, 557; 156/358, 359

[56] References Cited

U.S. PATENT DOCUMENTS

| | | | |
|---|---|---|---|
| 2,764,862 | 10/1956 | Rado | 53/550 X |
| 3,999,357 | 12/1976 | Marantz | 53/442 |
| 4,219,988 | 9/1980 | Shanklin et al. | 53/550 |
| 4,546,595 | 10/1985 | Yasumune et al. | 53/550 X |
| 4,658,569 | 4/1987 | Hanagata | 53/550 |

*Primary Examiner*—Robert L. Spruill

*Assistant Examiner*—Linda B. Johnson

*Attorney, Agent, or Firm*—Ronald E. Smith; Joseph C. Mason, Jr.

[57] ABSTRACT

A shrink wrap packaging machine that shrink wraps twice as many packages per unit of time as conventional machines. The machine includes a pair of longitudinally spaced sealing and cutting elements. Both elements are preceded by a sensor. The first sealing and cutting element is activated when the trailing edge of even numbered packages are detected whereas the second sealing and cutting element is activated when the second sensor detects the trailing edge of odd numbered packages. Packages are therefore wrapped in groups of two after leaving the first sealing and cutting station and are individually wrapped after leaving the second sealing and cutting station. The conveyor belt that carries packages through the machine operates at nearly twice the speed of prior art machines but the sealing and cutting elements of the present machines operate at the same rate as prior art machines.

14 Claims, 5 Drawing Sheets

Fig. 6
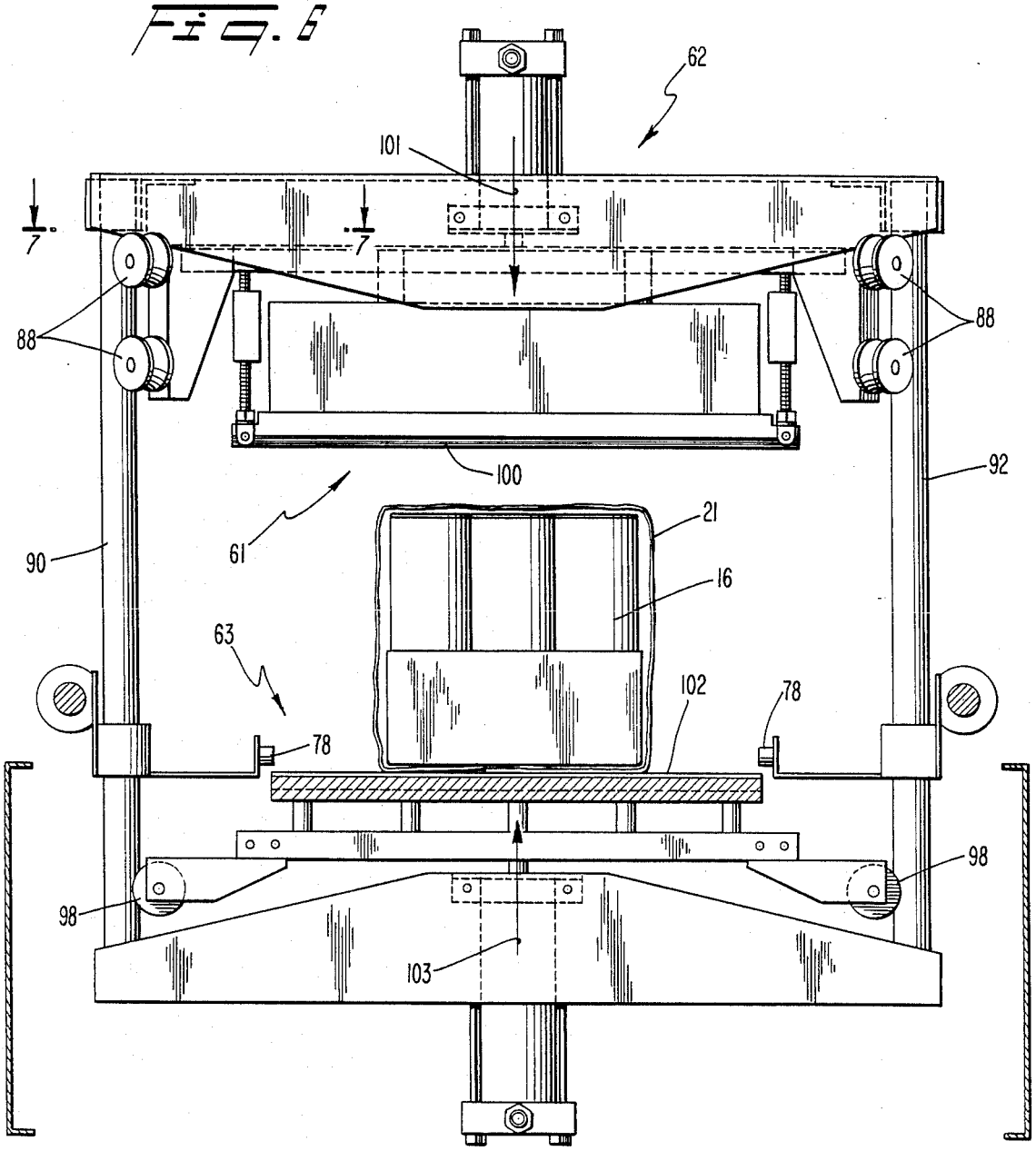
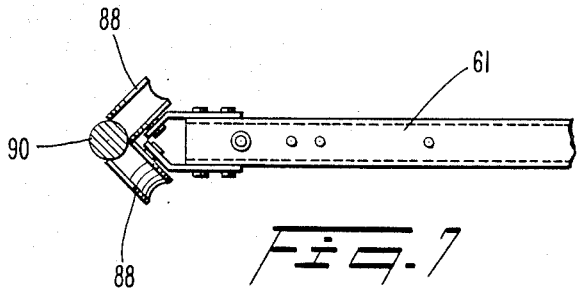
Fig. 7

MACHINES AND METHODS FOR DOUBLING THE CAPACITY OF PACKAGING MACHINES

TECHNICAL FIELD

This invention is in the field of packaging machines, specifically shrink wrap packaging machines. It involves a method whereby the capacities of such machines are doubled without increasing the rate of operation of a machine's sealing and cutting elements.

BACKGROUND ART

Shrink wrap packaging machines, in general, are well known. There are two primary types of such machines. In a first type, a large roll of flexible plastic is rotatably mounted on a spindle at the first stage of the machine. The plastic material is folded in half along its longitudinal extent and the beginning of the roll is fed to a metallic forming head that spreads or opens the folded plastic so that the trailing edges thereof are spaced apart a distance sufficient to receive a moving package therebetween while the leading edge thereof presents a yieldable wall to the package. A conveyor belt means conveys the lead package into the wall formed by the leading edge of the plastic and the package travels forwardly, forcing the fixed position roll of plastic to rotate about its spindles which results in additional lengths of plastic being unrolled from the roll. The additional length of plastic surrounds the sides of packages following the lead package.

After the lead package passes a predetermined point, a sealing and cutting means seals and cuts the plastic behind the lead package, which seal and cut is forwardly of the second package. After the plastic has been sealed and cut forwardly and rearwardly of each package, the packages enter a high temperature tunnel where the plastic shrinks into a tight wrapping engagement around the packages to produce the final product. In this type of machine, the package is completely covered by the wrapping material.

In a second type of machine, no forming head is used and the plastic film is not folded. Instead, two rolls of plastic are used; a first roll is positioned above the conveyor means that carries the packages and a second roll is positioned below the plane of the conveyor means. The leading edges of each roll of plastic film are joined, and packages are then fed through the machine so that the first package impinges against the yieldable wall and starts the rotation of the rolls to commence the wrapping process.

In the second type of machine, the top, bottom, front and back of the packages are completely covered by the plastic film, but the left and right sides thereof are only substantially covered, there being a small, generally circular opening known as a "bull's-eye" in the wrapping on said sides when the packages exit the heat tunnel.

The wrapping industry uses more machines of the second type than of the first; the subject invention has utility in connection with both types of machines.

Conventional shrink wrap packaging machines of both types employ a single sealing and cutting element to form the seal and to cut the plastic before and after each package in a series of packages.

Typically, such machines operate at a speed that wraps in plastic about 60 packages per minute. However, the machines may run faster, up to 100 packages per minute, when smaller packages are being wrapped.

Thus, the sealing and cutting elements (hereinafter referred to as the "sealing elements") reciprocate up and down at least 60 times per minute, and the conveyor belts run at an appropriate speed.

It is possible to speed up the rate of operation by simply running the conveyor belts at a higher rate of speed, coupled with a corresponding increase in the speed of operation of the sealing element. However, since the sealing element has considerable mass and has a reciprocating movement, the machine's rate of operation cannot be increased, as a practical matter, substantially beyond the machine's normal rate. Indeed, when conventional packaging machines of either type are run at an increased speed, they soon break down due to the mechanical stresses involved in high speed operation.

There are some multiple sealing and cutting station machines that have been built, but they do not follow the inventive methods disclosed herein. For example, there exists a multiple sealing station machine that employs a pair of sealing elements at longitudinally spaced sealing stations. Each element is mounted for rotary motion; to visualize the operation of rotary sealing element machines, one can envision a blade carried by a clock's second hand. Whenever an upper blade is in the six o'clock position and the lower blade is in the twelve o'clock position, the two blades will meet and form a seal and cut the plastic film. One obvious drawback of such machines is that the packages must be spaced rather far apart on the conveyor means due to the space required for the sweeping-motion blades.

Another multiple sealing and cutting station machine uses a square type of stroke like that of the present invention, but it also does not follow the inventive methods disclosed herein and as a result, it has numerous limitations and has not met with commercial success in the marketplace. As an example of its limitations, the space between packages on the conveyor belt means (which space is known as the "pitch") cannot be changed. In packaging machines, the ability to change the pitch so that the machine can accommodate differing package sizes is of primary importance. Moreover, the logic means required to maintain optimal conveyor belt speeds is complex in machines of this type. Due to these and other limitations, these machines have utility primarily in connection with smaller packages.

If the efficiency of both primary types (single and double roll) shrink wrap packaging machines could be doubled, by a means other than simply running them at twice the design speed, a new era of economical packaging could begin.

If such doubling of efficiency could be accomplished while still operating the sealing element at the relatively stress free, standard rate of 60 strokes per minute, (or whatever the machine's normal rate is) such an accomplishment would be a pioneering contribution to the art of packaging machines and methods.

However, the prior art is silent concerning how such a doubling of efficiency could be obtained.

DISCLOSURE OF INVENTION

A shrink wrap packaging machine that can wrap 120 packages per minute while its sealing elements operate at a rate of 60 strokes per minute is made possible by the novel method disclosed herein. Machines having a normal rate of 100 packages per minute can wrap 200 packages per minute if the novel methods disclosed herein are followed, i.e., the methods double a shrink wrap packaging machine's rate of production, without changing the rate of cyclic operation of its sealing and cutting elements.

The novel method involves the pioneering idea of, in effect, operating two prior art machines in series with one another while approximately doubling the speed of the conveyor means that carries packages through the machines. Hence, two machines, each operating at a rate of one sealing element stroke per unit of time, are, in effect, placed in serial alignment with one another; the first machine seals two packages in one elongate plastic package, i.e., the stroke of the first sealing element that normally occurs after the trailing edge of a package has passed a predetermined point is skipped by the first sealing element so that the plastic is sealed and cut forwardly of the leading edge of a first package in a group of two packages and rearwardly of the trailing edge of a second package immediately following the first.

The two packages then enter the second stage of the novel machine and are separated into two individual sealed packages by a second sealing element. The second element is triggered by detection of the trailing edge of the first package in each two package set.

In this manner, both sealing elements continue to operate at their usual number of packages per minute rate, but twice as many shrink wrapped packages per minute are produced by the machine due to the increased speed of the conveyor belt means and due to the novel use of two sealing elements.

However, the dual sealing element machine of this invention is not simply an aggregation of two prior art machines placed in linear alignment with one another, as the novel machine uses a single shrinking tunnel, an increased speed conveyor means, and has been modified in several other important ways as well in order to carry out the novel idea. However, the inventive method is perhaps best initially understood by thinking of the novel machine as two prior art machines operated in the inventive manner just described.

The primary object of this invention is to double the efficiency of shrink wrap packaging machines without increasing the rate of operation of the sealing and cutting elements thereof.

The invention accordingly comprises the features of construction, combination of elements and arrangement of parts that will be exemplified in the descriptions set forth hereinafter and the scope of the invention will be set forth in the claims.

BRIEF DESCRIPTION OF DRAWINGS

For a fuller understanding of the nature and objects of the invention, reference should be made to the following detailed description, taken in connection with the accompanying drawings, in which:

FIG. 6 is a sectional view taken along line 6—6 in FIG. 5;

FIG. 7 is a sectional view taken along line 7—7 in FIG. 6;

Similar reference numerals refer to similar parts throughout the several views of the drawings.

BEST MODES FOR CARRYING OUT THE INVENTION

This invention is best understood and appreciated from the perspective of a prior art machine.

Figure 1:
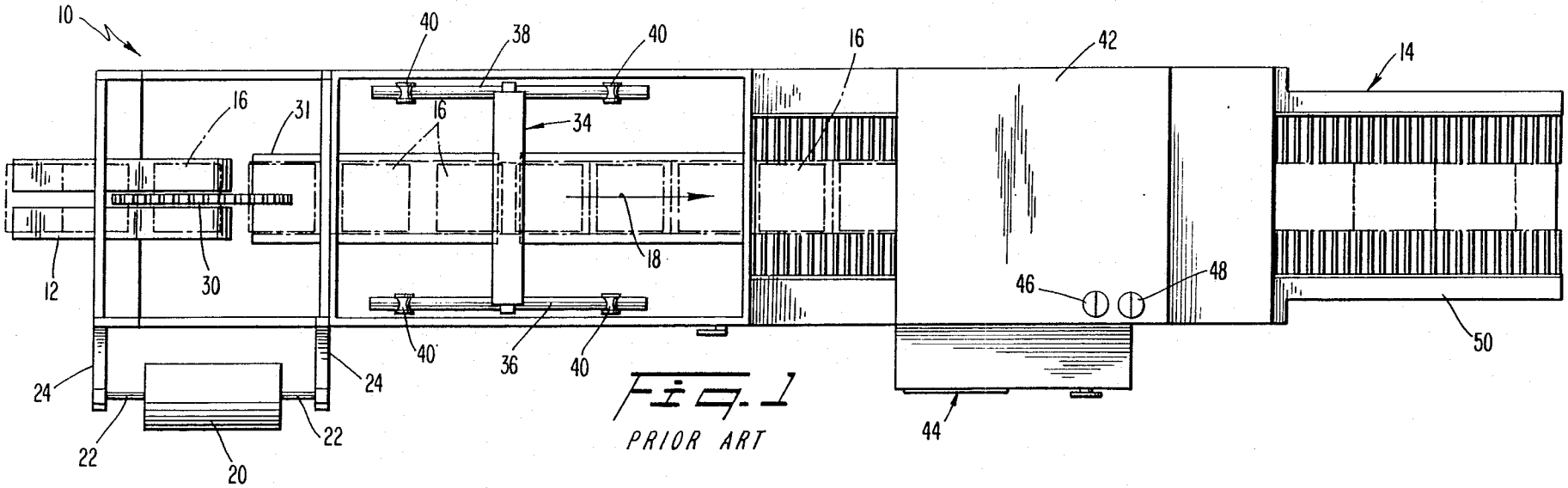
FIG. 1 PRIOR ART
FIG. 1 is a top plan view of a prior art shrink wrap packaging machine.
Figure 2:
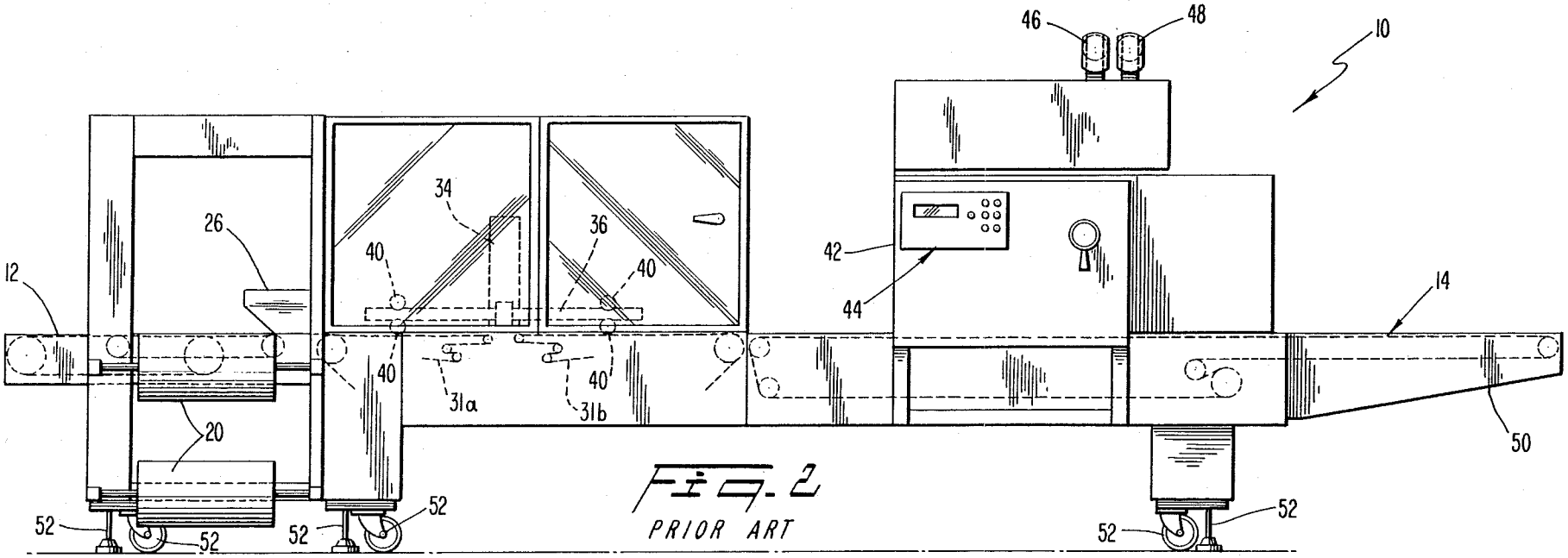
FIG. 2 PRIOR ART
FIG. 2 is a side elevational view of the prior art machine of FIG. 1.

In the prior art machine of FIGS. 1 and 2, the reference numeral 10 designates the device as a whole; the input or rearward end of the machine is denoted 12 and the output or forward end thereof is denoted 14. The packages that pass through the machine are denoted 16 in FIG. 1; they follow the path of travel indicated by the single headed directional arrow 18 in FIG. 1.

Figure 9:
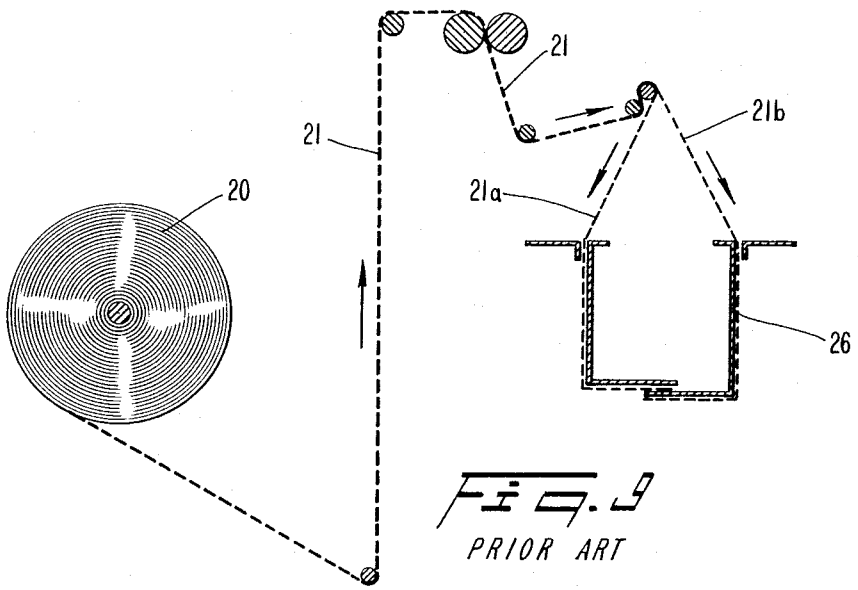
FIG. 9 PRIOR ART
FIG. 9 is an end view of a roll of plastic and a forming head means of the prior art.

A roll of plastic wrapping material 20 is rotatably mounted on spindle 22 that is journaled to ear members 24 secured to the frame of machine 10 near its input end 12. A second roll 20 is merely a spare roll. The plastic 21 is folded along its longitudinal axis of symmetry while stored on roll 20; forming head 26 serves to spread open the trailing edges 21*a*, 21*b* (FIG. 9) thereof to receive a package entering the machine at its input end 12. FIG. 9 perhaps best depicts how the forming head 26 works.

Packages 16 entering forming head 26 are chain driven by chain 30; otherwise, they are conveyed through the machine by a conveyor belt means 31 that is discontinuous at the sealing element as shown in FIG. 2.

Figure 8:
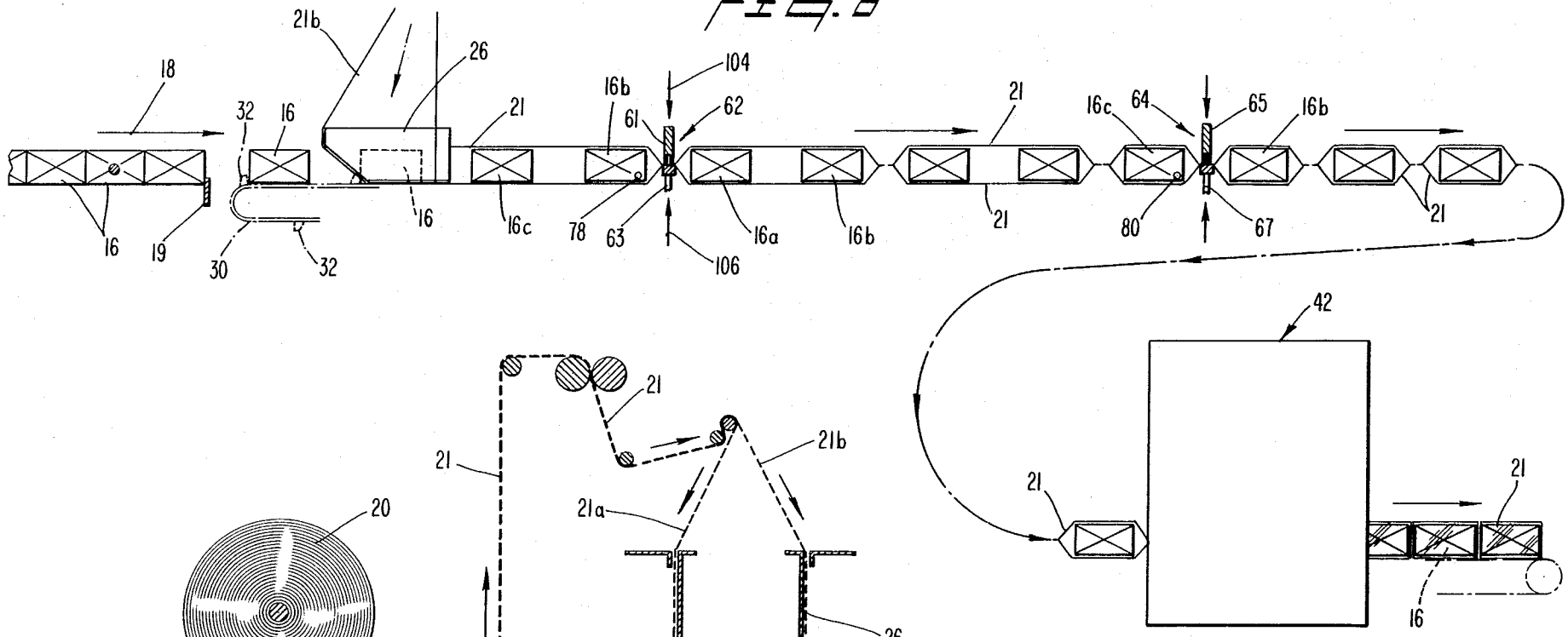
FIG. 8 is a diagramatic view showing how the steps of the novel method are carried out by a machine.

As shown in FIG. 8, chain 30 carries push members 32 which push packages 16 into the forming head 26. The chain drive just described and the forming head 26 appearing in FIG. 8 are the only structural elements in FIG. 8 which form a part of the prior art, i.e., the balance of FIG. 8 diagrammatically depicts the novel, heretofore unknown method of this invention, and said FIG. 8 will be referred to more fully hereinafter.

As mentioned earlier, prior art machine lacking forming heads and having a first upper roll and a second lower roll are more common than the depicted machine; the forming head 26 forms no part of this invention and this invention has equal applicability in connection with the two roll machines that produce packages having "bull's-eyes."

As shown in FIGS. 1 and 2, packages leaving the forming head 26 next approach the sealing element 34; said element is somewhat the same for both the prior art machine and the novel machine, with one difference being that the novel machine has two independently operable, longitudinally spaced sealing elements as will be more fully set forth hereinafter.

Sealing element 34 of prior art machine 10 includes a pair of longitudinally extending parallel track members 36, 38. Sealing element 34 travels forwardly and rearwardly along the extent of tracks 36, 38, which movement is made possible by roller members collectively denoted 40.

Sealing element 34 has an upper and a lower blade which reciprocate in a vertical plane to effect the sealing and cutting of the plastic around the package, it being understood that the blades are heated to form a seal by melting the plastic. The upper blade travels downwardly and forwardly while the lower blade travels upwardly and forwardly so that the two blades meet to effect the seal and cut near the output or forward end of track members 36, 38.

Once a seal has been formed by pinching the plastic between the heated upper and lower blades and the cut has been made by the same blade members, both the upper and lower blade members return to their respective raised and lowered positions and retract relatively quickly to a position toward the input or rearward end of tracks 36, 38 so that the sealing and cutting cycle can repeat for the next package. It is important to note that the sealing element goes through its complete cycle for each package and due to the mass of the sealing element and the stresses appearing therein, it is not commercially feasible to run more than a certain number of packages per minute through machine 10; accordingly, the conveyor belts of conventional machines are run at a rate keyed to a practical rate of sealing element operation. Typically, machines run at about 60 packages per minute for larger packages and up to about 100 packages per minute for smaller packages.

The individually sealed packages are loosely wrapped as they leave the sealing and cutting station; the final shrink wrapping occurs in tunnel 42 where the elevated temperature therein causes the plastic to shrink and to tightly wrap around each package. The temperature of the tunnel, the speed of the sealing and cutting element reciprocation, and other machine variables such as the speed of the conveyor belt are operator controlled; control panel 44 provides the means whereby the operator sets the desired operating parameters. Lights 46, 48 are "go" and "stop" lights indicating normal and abnormal operating conditions, respectively.

Upon leaving tunnel 42, the wrapped packages are removed from unloading station 50 by any suitable means.

FIG. 2 also shows that conveyor means 31 is discontinuous in the region of sealing element 34. This discontinuity allows operation of the sealing element and is also needed because belts 31*a* and 31*b* do not operate at the same speed at all times. For example, when the trailing or rearward edge of a package wrapper is being sealed, belt 31*b* will operate at a slower speed briefly to reduce the stress on the plastic as it is sealed and cut by element 34.

It might also be noted that the prior art machine 10 is supported by three sets of caster wheels and levelers, collectively denoted 52.

Figure 3:
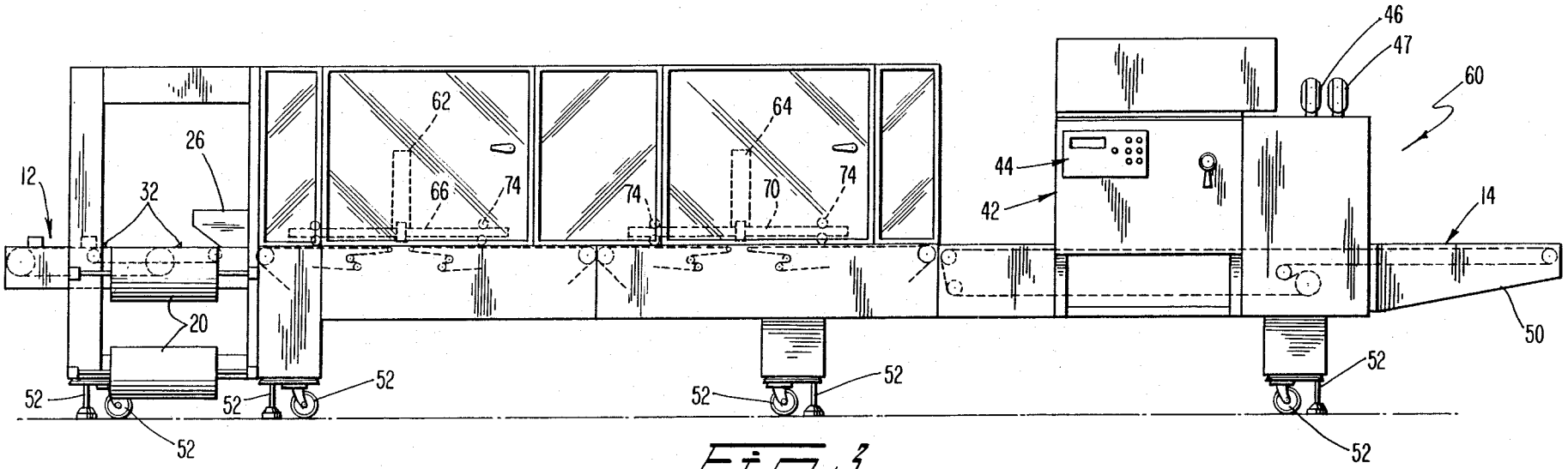
FIG. 3 is a side elevational view of a machine capable of performing the novel methods disclosed herein.
Figure 4:
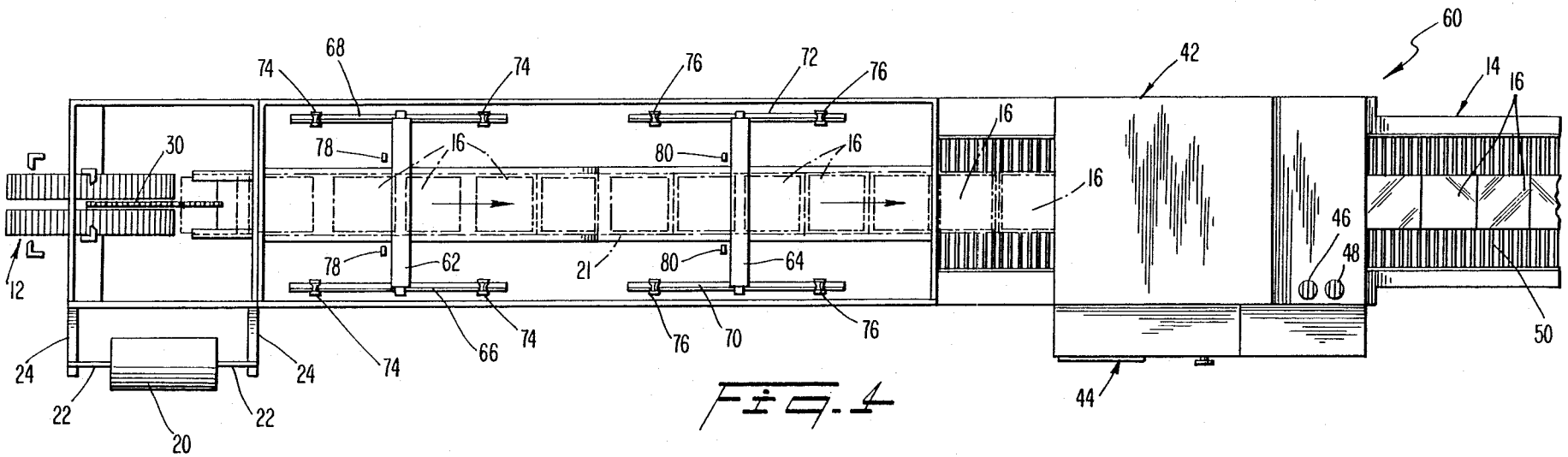
FIG. 4 is a top plan view of the machine of FIG. 3.

FIGS. 3 and 4 show a machine capable of performing the steps of the novel method; said machine is denoted by the reference numeral 60 as a whole. The minor parts of machine 60 that have counterparts in the prior art machine 10 are indicated by the same reference numerals and will not be redescribed to shorten the length of this description.

It will be noted that the novel machine 60 has two longitudinally spaced sealing and cutting elements, denoted 62 and 64, generally. Sealing elements 62 and 64 are mounted on tracks 66, 68 and 70, 72, respectively. Roller members 74 are associated with element 62 and rollers 76 are associated with element 64.

A first electric eye means 78 is mounted near the input or forward end of first sealing element 62 as shown and a second electric eye means 80 is similarly positioned relative to the second sealing element 64. Thus, each sealing element 62, 64 operates on demand, i.e., the elements are not in timed synchronization with one another and instead operate under the control of their respective electric eyes entirely independently of each other.

Figure 5:
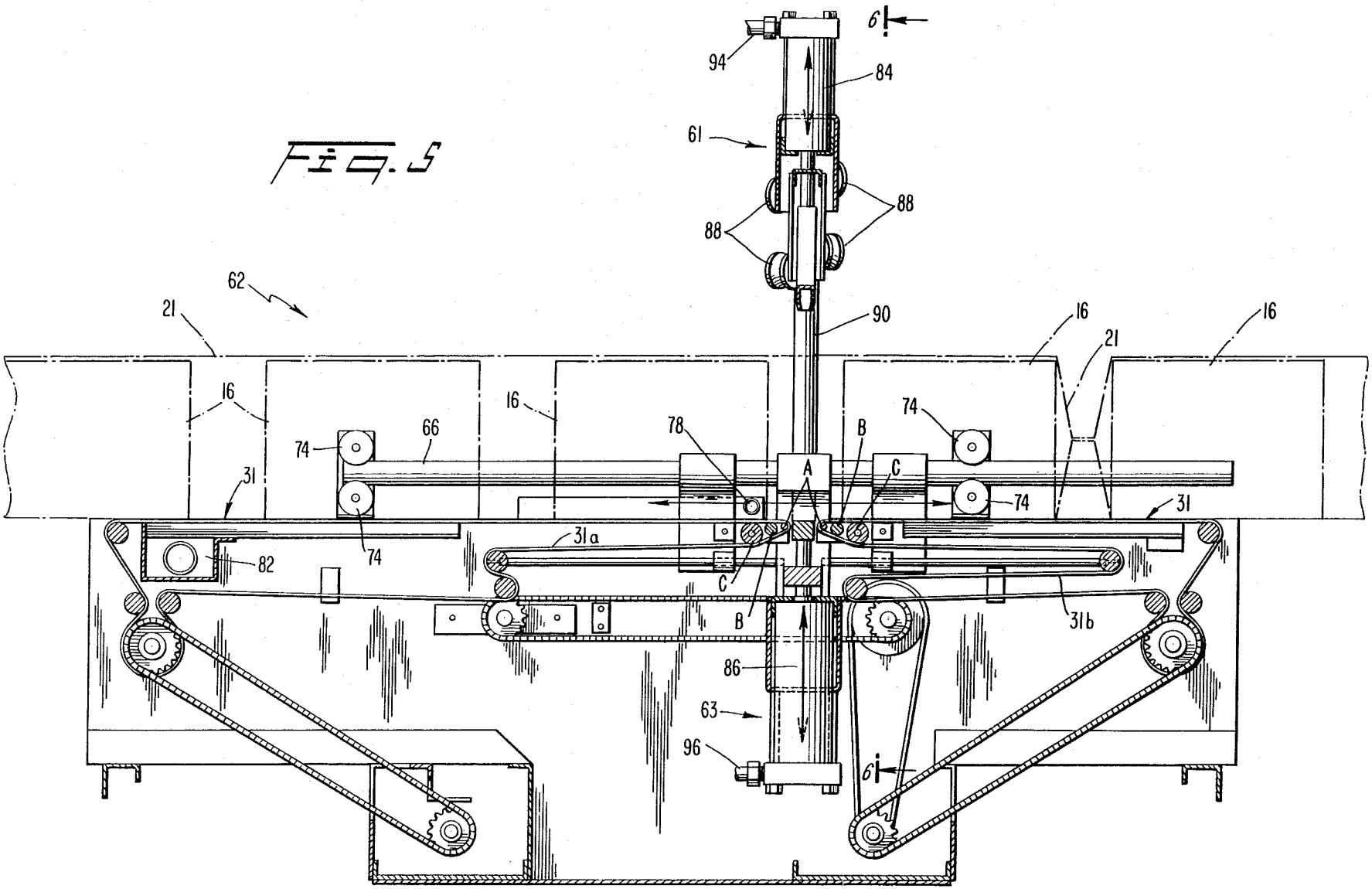
FIG. 5 is an enlarged side elevational view of a portion of FIG. 3.

The first sealing element 62 is shown in side elevation and in greater detail in FIG. 5; a source of negative pressure 82 retains each package tightly against conveyor belt 31 as said package enters the sealing and cutting station; no such source of negative pressure is employed at the second sealing and cutting station.

The upper portion, generally, of sealing element 62 is denoted 61 in FIG. 5 and its lower portion is generally denoted 63. The vertical oscillation of the upper portion 61 is indicated by the double headed directional arrow 84 in FIG. 5 and the vertical oscillation of the lower portion 63 thereof is denoted as at 86.

Plural roller members, collectively denoted 88, guide the upper portion 61 as it oscillates; the specific connections between rollers 88 and portion 61 is perhaps best depicted in FIGS. 7 and 8 wherein it is shown that rollers 88 rotatably engage upstanding laterally spaced post members 90, 92. The respective axes of rotation of the rollers are normal to one another as shown in FIG. 7; this novel arrangement provides a low friction, stable and reliable guide means for upper portion 61 of sealing element 62.

Upper portion 61 is pneumatically controlled as suggested by air hose 94 appearing at the top of FIG. 5. Similarly, lower portion 63 of sealing element 62 is pneumatically controlled as well as suggested by air hose 96 appearing at the bottom of said Fig.

Lower rollers 98 also rotatably engage post 90 and serve to guide lower portion 63.

As in prior art machines, belts 31*a* and 31*b* are longitudinally spaced from one another so that lower portion 63 of sealing element 62 can travel above the plane of conveyor means 31 during the sealing and cutting operation and so that the speed and direction of travel of the individual belts can be independently controlled.

In machines of the forming head type, belt 31*b* runs slower during the cutting and sealing operation at both sealing and cutting stations 62, 64; in machines of the double roll type, there is no need to run belt 31*b* slower at the first station 62, but belt 31*b* is run slower at station 64. It should also be understood that for packages of low height, belt 31*b* need not be run slower at either station 62 or 64, since the flexibility of the plastic is sufficient to allow the sealing and cutting to be accomplished in the absence of belt slowing since no additional slack is needed when such small packages are being wrapped.

When a seal is to be made, the leading edge 100 of upper portion 61 lowers as indicated by arrow 101 at the top of FIG. 6 and the leading edge 102 of the lower portion 63 rises as indicated by directional arrow 103 at the bottom of said Fig. Simultaneously, both the upper and lower portion 61 and 63 of element 62 travel forwardly toward the output end 14 of machine 60 at the same speed as each other. Thus, when the blades 100, 102 meet, there is no relative motion between said blades and the plastic 21 so that a transverse seal is made in the plastic and so that the plastic is simultaneously cut along a transverse center line of the seal.

The seal so made is loose, as indicated by the loose wrapping of plastic 21 about packages 6 in FIG. 6 and as indicated at the right side of FIG. 5 as well, it being understood that the final shrinking in heat tunnel 42 produces the final plastic-wrapped package.

Having provided an overview of the parts of a machine that carries out the steps of the novel method, reference is now made to FIG. 8. The structural elements of FIG. 8 have heretofore been described (with the exception of vertically reciprocating stop member 19 that serves to space packages 16 as suggested); accordingly, the steps of the novel method can now be described.

When electric eye 78 detects the trailing edge of a package 16, it sends a signal to the pneumatic means that controls the first sealing element 62 and said sealing element immediately starts traveling in a longitudinal direction toward the output end 14 of machine 60 and upper and lower elements 61, 63 thereof begin to converge as indicated by arrows 104, 106 in FIG. 8. The seal and cut are made as indicated in FIG. 8 when the detected trailing edge of a package 16*a* is beyond the eye 78 as shown.

However, eye 78 is programmed to not activate sealing and cutting element 62 when it detects the leading and trailing edge of package 16*b* and the leading edge of package 16*c*. The cutting and sealing cycle is activated and repeats when the trailing edge of package 16*c* breaks the beam of the electric eye member 78. Thus, sensing means 78 responds to the trailing edge of alternate, even-numbered packages only.

Electric eye 80 operates in a similar manner; it responds to the trailing edge of package 16*b* as indicated at the right side of FIG. 8, i.e., it responds to odd-numbered packages only.

The novel method thus includes the step of presenting a serial array of packages to a first electric eye means and to a second electric eye means longitudinally spaced from the first electric eye means. The first electric eye means responds to the trailing edge of a second package in a serial array of packages and alternate or even numbered packages thereafter and initiates a sealing and cutting operation that causes loosely wrapped plastic at the trailing end of alternate, even-numbered packages to be heat sealed and cut. A second electric eye means, longitudinally spaced from the first, then detects the trailing edge of a first package in a pair of packages and all alternate or odd-numbered packages thereafter and causes a second heating and cutting element to activate.

In this manner, two packages are contained in a single wrapper after leaving the first electric eye and sealing station and they are individually wrapped after leaving the second electric eye and sealing station.

This novel arrangement of parts doubles the production of the machine in the absence of a need to increase the rate of operation of the first and second sealing and cutting elements; the elements operate at their standard rate. The inventive arrangement of part thus allows the conveyor means to be operated at approximately double speed, but since such motion is rotary, no appreciable mechanical problems are encountered. Typically, a conveyor belt may be operated at 1.8 or 1.9 times its normal rate of speed in a machine of the type disclosed herein.

Those skilled in the mechanical arts will appreciate the fact that machines having three or more longitudinally spaced sealing and cutting stations become obvious in the light of this disclosure, i.e., the disclosure of a second sealing and cutting station and the novel methods disclosed herein suggest machines having more than two sealing and cutting stations which are operated in accordance with the teachings of this breakthrough invention.

INDUSTRIAL APPLICABILITY

This invention will have a major impact on the shrink wrap packaging industry; it revolutionizes the art and makes the machines and methods of the prior art obsolete.

It will thus be seen that the objects set forth above, and those made apparent from the foregoing description, are efficiently attained and since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described, what is claimed is:

1. A method of wrapping packages in a plastic wrapper, comprising the steps of:

arranging a plurality of packages in serial alignment with one another;

rotatably mounting at least one roll of plastic adjacent said array of packages;

partially unrolling said at least one roll of plastic;

forming a yieldable wall of plastic with an unrolled portion of said plastic;

positioning said yieldable wall of plastic forwardly of a lead package in said serial array of packages;

conveying said packages, in a common forwardly direction, toward said yieldable wall of plastic so that said lead package impinges against said wall and displaces it in said forward direction of package travel, causing said at least one roll to further unroll so that plastic from said at least one roll covers at least the tops and bottoms of packages following said lead package;

positioning a first sealing and cutting element forwardly of said wall of yieldable plastic, in longitudinally spaced relation thereto;

positioning at least a second sealing and cutting element forwardly of said first sealing and cutting element, in longitudinally spaced relation thereto;

positioning a first sensing means rearwardly of said first sealing and cutting element;

positioning a second sensing means rearwardly of said second sealing and cutting element;

activating said first sealing and cutting element when said first sensing means detects the trailing edge of an even numbered package in said array of packages; and activating said second sealing and cutting element when said second sensing means detects the trailing edge of an odd numbered package in said array of packages;

whereby said first and second sealing and cutting elements operate independently of one another;

whereby said first and second sealing and cutting elements operate at substantially the same speed; and whereby the number of packages individually wrapped per unit of time is twice the number of packages capable of being individually wrapped by a single sealing and cutting element.

2. The method of claim 1, further comprising the step of increasing the rate of conveyance of said packages through said machine to a predetermined number of packages per minute and activating said first and second sealing and cutting elements a predetermined number of times per minute equal to about one-half said predetermined number of packages per minute.

3. The method of claim 1, further comprising the step of conveying all of said packages into a plastic shrinking station that is positioned forwardly of said second sealing and cutting element.

4. A method of shrink wrapping individual packages that are disposed in serial alignment with one another and traveling in a common, forwardly direction, comprising the steps of:

at least partially covering the sides of said packages with an elongate plastic wrapping means;

cutting and loosely sealing said plastic wrapping means just forwardly of alternate packages in said array of packages at a first sealing and cutting station so that said packages are loosely wrapped in groups of two packages after traveling past said first sealing and cutting station;

dividing each of said groups of two packages into individually wrapped packages by passing said group of two packages through a second sealing and cutting station that is spaced forwardly of said first sealing and cutting station, said second sealing and cutting station loosely sealing and cutting said plastic wrapping means intermediate said packages in said groups of two packages to thereby produce individually wrapped packages; and shrinking said loose plastic wrapping means surrounding said individually-wrapped packages in an elevated temperature plastic shrinking station;

whereby the number of individually wrapped packages produced per unit of time is about double the number produced by a single sealing and cutting element operating at substantially the same cyclic rate as said first and second sealing and cutting elements.

5. The method of claim 4, further comprising the step of increasing the rate of travel of said packages per minute through said machine to approximately twice the speed of operation of said first and second sealing and cutting station, respectively.

6. A shrink wrap packaging machine, comprising:

an elongate frame means;

at least a first and second sealing and cutting element positioned at predetermined respective locations along the longitudinal extent of said frame means;

at least a first and second sensing means positioned at predetermined respective locations along the longitudinal extent of said frame means;

a conveyor means for carrying packages to be individually wrapped by said machine;

said conveyor means being operative to carry said packages, in sequence, past said first sensing means, said first sealing and cutting element, said second sensing means and said second sealing and cutting element;

said first sensing means being operative to activate said first sealing and cutting element when said first sensing means detects the trailing edge of every other package in a series of packages carried by said conveyor means;

said second sensing element being operative to activate said second sealing and cutting element when said second sensing means detects the trailing edge of a package not sensed by said first sensing means said first sealing and cutting element being operative to loosely wrap said packages into groups of two packages each; and said second sealing and cutting element being operative to divide said packages in groups of two into individual loosely wrapped packages.

7. The machine of claim 6, further comprising a plastic shrinking station to which said conveyor means delivers said loosely wrapped packages so that elevated temperatures at said station shrink the plastic into tight fitting relation to the individual packages.

8. The machine of claim 6, wherein said first and second sealing and cutting elements have respective top and bottom portions mounted for reciprocating motion in a vertical plane, wherein said respective top and bottom portions travel downwardly and upwardly, respectively, and are heated to seal and cut said plastic wrapping means by pinching said plastic wrapping means therebetween, and wherein said first and second sealing and cutting elements are also mounted for reciprocating travel in a longitudinal direction, said elements traveling in a forward longitudinal direction when their respective top and bottom portions are converging toward one another and said elements traveling in a rearward longitudinal direction when their respective top and bottom portions are diverging away from one another.

9. The machine of claim 8, wherein said conveyor means is discontinuous at each of said sealing and cutting element locations to allow said respective bottom portions of said elements to perform their respective upward and downward strokes and to allow independent operation of conveyor belt portions on opposite sides of said elements.

10. The machine of claim 9, wherein a conveyor belt portion positioned forwardly of a sealing and cutting element travels at a slower speed during a sealing and cutting operation.

11. The machine of claim 6, wherein said conveyor means operates at a speed sufficient to carry more than 120 packages per minute through said machine.

12. The machine of claim 6, wherein said conveyor means operates at a speed sufficient to carry more than 200 packages per minute through said machine.

13. The machine of claim 6, wherein each of said first and second sealing and cutting elements operates at a rate of about one seal and cut per second.

14. The machine of claim 12, wherein said first and second sealing and cutting elements each operate at a rate of about one seal and cut per second.

* * * * *